US008251727B2

(12) United States Patent
Zhu

(10) Patent No.: US 8,251,727 B2
(45) **Date of Patent: *Aug. 28, 2012**

(54) CARD EDGE CONNECTOR WITH FLOATING PAD

(75) Inventor: Jian-Kuang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/987,837

(22) Filed: Jan. 10, 2011

(65) Prior Publication Data

US 2011/0171847 A1 Jul. 14, 2011

(51) Int. Cl.
*H01R 13/62* (2006.01)

(52) U.S. Cl. ..... 439/327

(58) Field of Classification Search ..... 439/64, 439/325–327

See application file for complete search history.

(56) References Cited

U.S. PATENT DOCUMENTS 7,074,067 B2 7/2006 Yang et al.
8,052,449 B2 * 11/2011 Zhu ..... 439/326

* cited by examiner

*Primary Examiner* — Khiem Nguyen
(74) *Attorney, Agent, or Firm* — Wei Te Chung; Andrew C. Cheng; Ming Chieh Chang

(57) ABSTRACT

A card edge connector includes an elongated housing defining a mating cavity extending along a longitudinal direction and a pair of arms disposed at opposite ends of the mating cavity and a supporting portion unitarily extending forward from the housing. A plurality of contacts are divided into an upper row and a lower row and respectively secured on opposite sides of the mating cavity. Metallic devices comprise a pair of retaining members respectively attached to the arms and a pair of soldering pads respectively assembled onto the supporting portions along a front-to-rear direction perpendicular to the longitudinal direction. Each supporting portion defines a receiving slot running through a front face of the supporting portion and extending along the front-to-rear direction for receiving said soldering pad under condition that the soldering pad could floatably move within the receiving slot.

14 Claims, 5 Drawing Sheets

CARD EDGE CONNECTOR WITH FLOATING PAD

BACKGROUND OF THE INVENTION

1. Field of the Invention

The present invention relates to a card edge connector, and in particular to a card edge connector provided with a pair of floating pads thereon.

2. Description of the Related Art

U.S. Pat. No. 7,074,067 issued to Yang et al. on Jul. 11, 2006 discloses a conventional card edge connector for connecting an electrical card to a circuit board so as to realize electrical connection therebetween. The card edge connector includes an insulative housing defining an elongated central slot therein and provided with a plurality of terminals at opposite sides thereof for receiving the electrical card therein. A pair of latching arms are arranged at opposite longitudinal ends of the insulative housing for locking with the electrical card. Each latching arm extends forward from the insulative housing and defines a locking portion at a distal end thereof for retaining the electrical card. As the latching arm is made of plastic material, for improving the rigidity of the latching arm, a metallic retaining member is provided and assembled onto the latching arm. The retaining member comprises an elongated body portion attached to the latching arm, a strengthening plate extending from an upper edge of the body portion, and a solder portion extending laterally and then downwardly so as to be mounted onto a printed circuit board.

When the card edge connector is mounted onto the printed circuit board, the soldering heat will be brought by the terminals and results deformation of the insulative housing, which will bring some trouble for the soldering process of the retaining member. Obviously, an improved card edge connector is highly desired to overcome the aforementioned problem.

SUMMARY OF THE INVENTION

Accordingly, an object of the present invention is to provide a card edge connector which is soldered onto a printed circuit board steadily.

In order to achieve the object set forth, a card edge connector for connecting an electrical card to a printed circuit board comprises an elongated housing defining a mating cavity extending along a longitudinal direction and a pair of arms disposed at opposite ends of the mating cavity and a supporting portion unitarily extending forward from the housing. A plurality of contacts are divided into an upper row and a lower row and respectively secured on opposite sides of the mating cavity. Metallic devices comprise a pair of retaining members respectively attached to the arms and a pair of soldering pads respectively assembled onto the supporting portions along a front-to-rear direction perpendicular to the longitudinal direction. Each supporting portion defines a receiving slot running through a front face of the supporting portion and extending along the front-to-rear direction for receiving said soldering pad under condition that the soldering pad could floatably move within the receiving slot.

Other objects, advantages and novel features of the invention will become more apparent from the following detailed description of the present embodiment when taken in conjunction with the accompanying drawings.

DETAILED DESCRIPTION OF THE INVENTION

Figure 1:
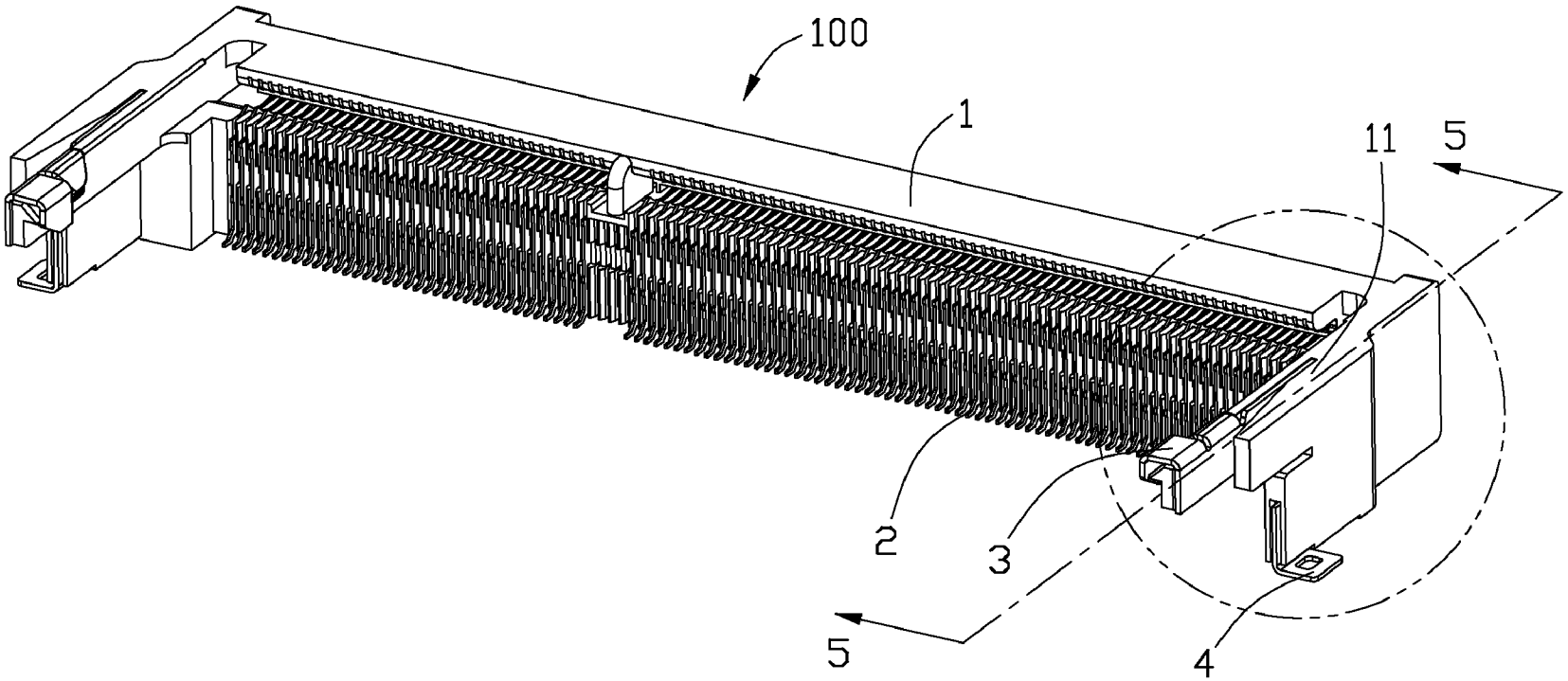
FIG. 1 is a perspective view of a card edge connector in accordance with the present invention.
Figure 2:
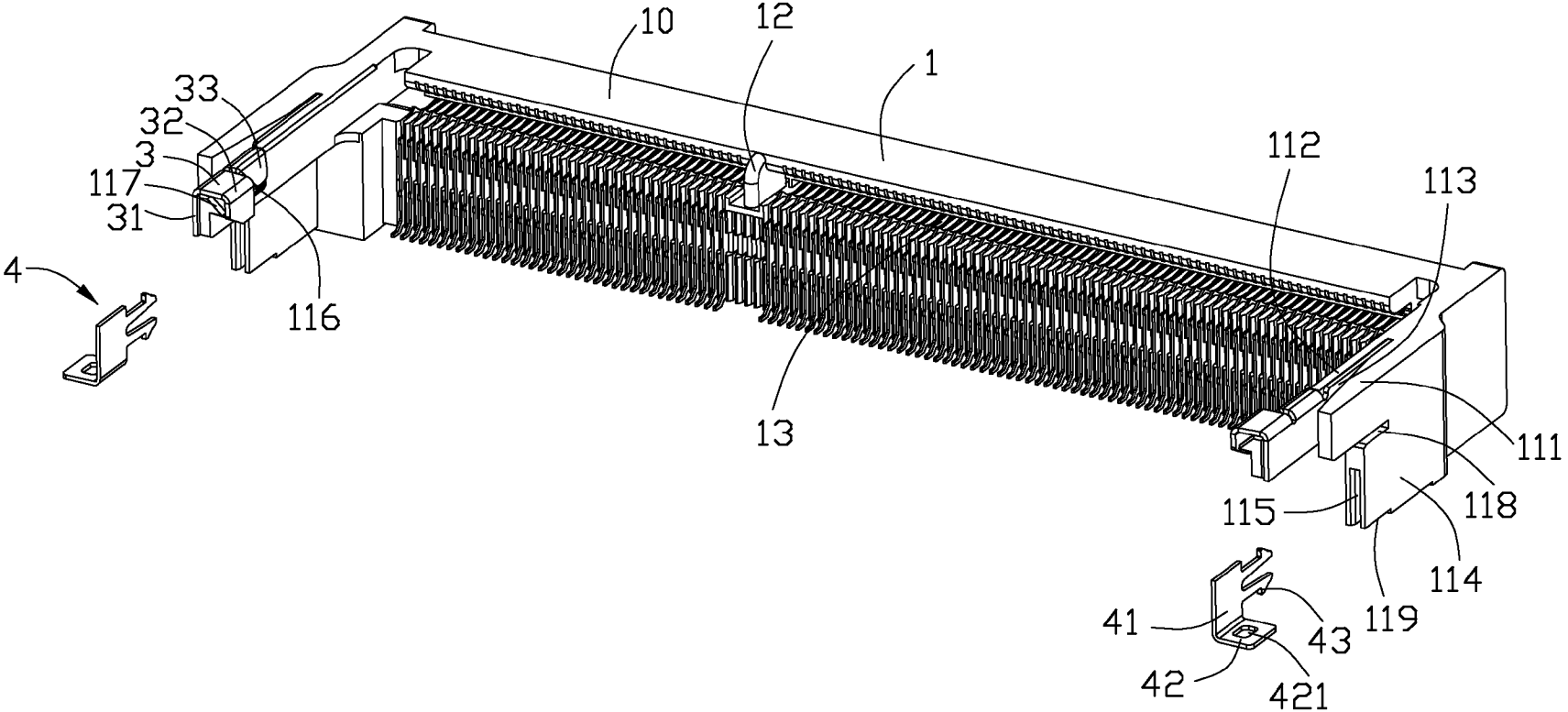
FIG. 2 is a partly exploded perspective view of the card edge connector shown in FIG. 1.
Figure 3:
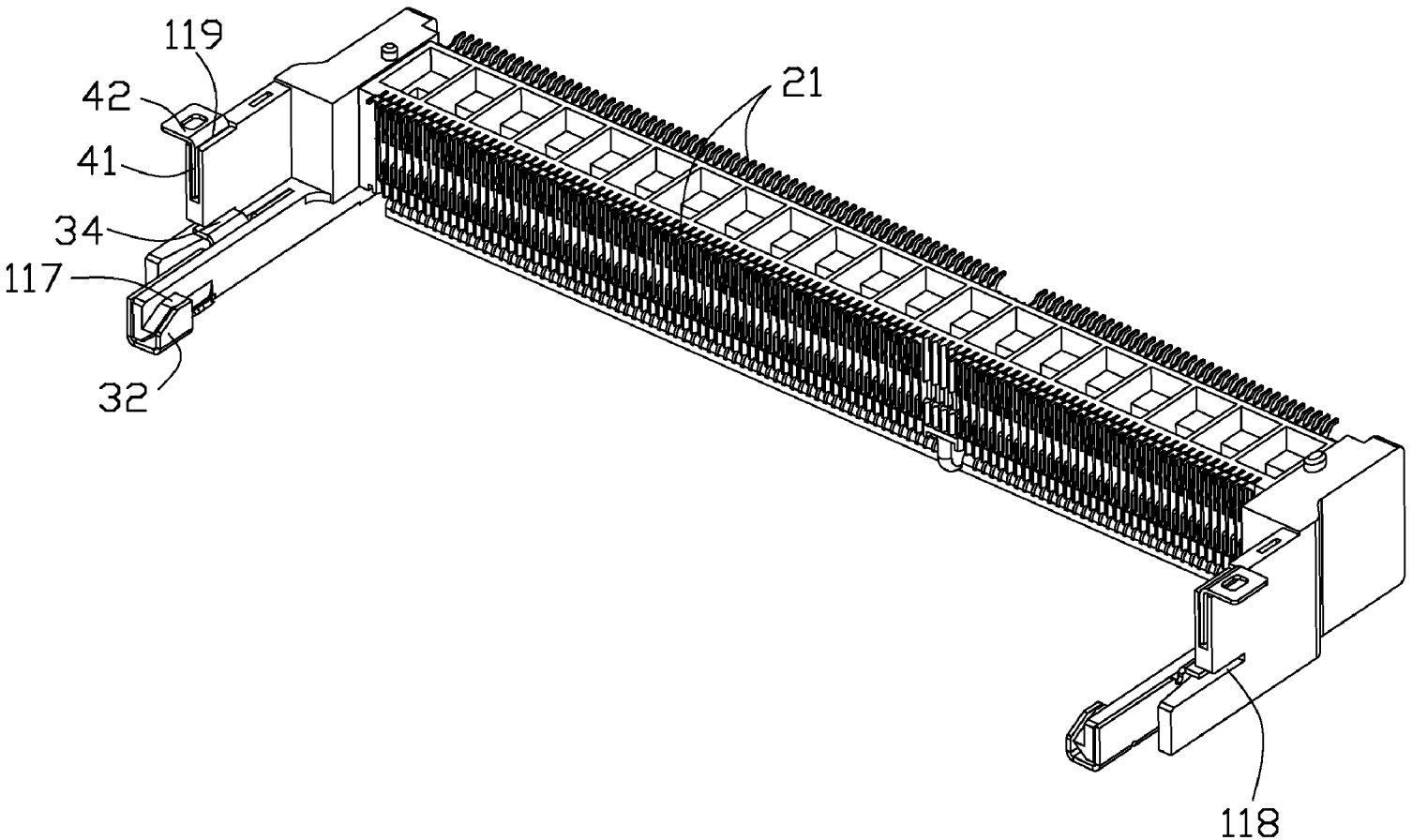
FIG. 3 is another perspective view of the card edge connector shown in FIG. 1.

Reference will now be made to the drawing figures to describe a preferred embodiment of the present invention in detail. Referring to FIG. 1 to FIG. 3, a card edge connector 100 according to the preferred embodiment of the present invention is provided and comprises an insulative housing 1 with a plurality of conductive terminals 2 received therein and a pair of strengthening plates 3 and soldering pads 4 assembled on the insulative housing 1. The strengthening plates 3 and soldering pads 4 are both metallic material and separately formed, which can simplify the manufacturing process of the two components.

Referring to FIGS. 2 and 3, the insulative housing 1 comprises an elongated base portion 10 and a pair of arms 11 disposed at opposite longitudinal ends of the base portion 10 and extending along a mating direction. A mating groove 13 is defined along a longitudinal direction of the base portion 10 and opened forwardly for receiving a front edge of an electrical card therein. The conductive terminals 2 are arranged as an upper row and a lower row and respectively retained at opposite sides of the mating groove 13. A key 12 for cooperating with a notch defined at the front edge of the electrical card is formed in the mating groove 13 adjacent to one of the arms 11 thereby dividing the mating groove 13 into two separated parts. Each arm 11 is configured as a fork shape and comprises a first side arm 111, a second side arm 112 and a receiving space 113 defined therebetween. The first side arm 111 is located at a lateral side of the second side arm 112 for preventing the second side arm 112 from moving outwardly overly. Each second side arm 112 forms a guiding portion 116 and a locking portion 117 at a distal end thereof and respectively protruding inwardly. For improving the rigidity of the second side arms 112, the strengthening plates 3 are provided to insert into the corresponding receiving spaces 113 and attached to the second side arms 112. Each strengthening plate 3 comprises a base plate 31 attached to an outer side of the second side arm 112, a topping plate 32 and a guiding plate 33 extending from an upper edge of the base plate 31 and bending inwardly and downwardly to cooperate with the corresponding locking portion 117 and guiding portion 116, and a buckling portion 34 extending from a lower edge of the base plate 31 and bending outwardly to abut against a bottom face of the first side arm 111.

Figure 4:
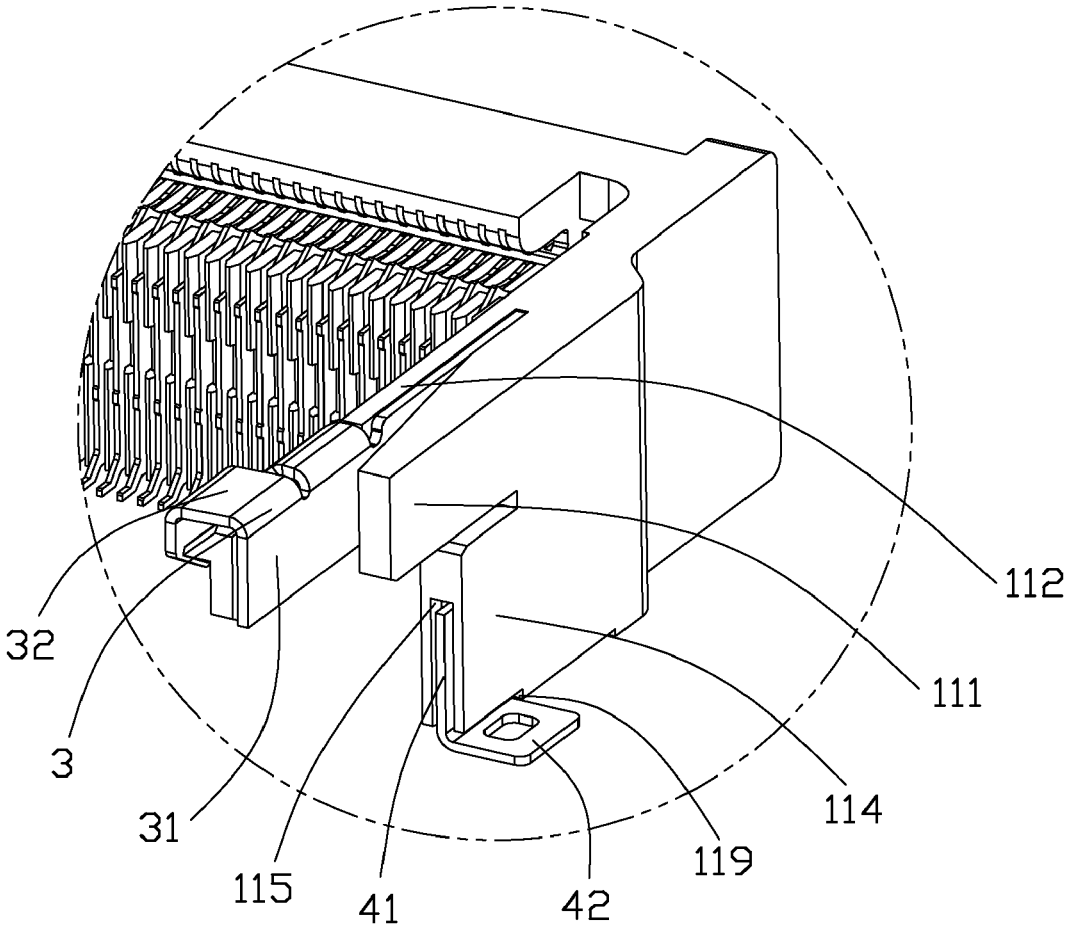
FIG. 4 is a partly amplified view of the card edge connector shown in FIG. 1.

Referring to FIG. 2 to FIG. 4, the card edge connector of the present invention has a high profile, a supporting portion 114 unitarily extends forward from the base portion 110 but spaced to the first side arm 111 thereby leaving an interval 118 therebetween. The supporting portion 114 stands on a printed circuit board when the card edge connector 100 is mounted onto said printed circuit board. The buckling portion 34 of the strengthening plate 3 is received in the interval 118, when the second side arm 112 is moved upwardly by accident, the buckling portion 34 will abut against the first side arm 111 and prevent the second side arm 112 from moving upwardly overly. A vertical receiving slot 115 further extends rearward from a front face of the supporting portion 114 for receiving the soldering pad 4, and detailed structure of the vertical receiving slot 115 will be described later.

Each soldering pad 4 is made from a metal plate and comprises a rectangular body portion 41, a solder portion 42 perpendicularly extending from the body portion 41, and a pair of locking portions 43 formed a fork shaped configuration and extending rearward from a rear end of the body portion 41. The locking portions 43 and the body portion 41 are located at a same plane, and each locking portion 43 has an elongated connecting portion 431 straightly extending from the body portion 41 and a hook 432 protruding outwardly from a distal end thereof. An opening 421 is defined on the solder portion 42 for concentrating more solder thereon during the soldering process.

Figure 5:
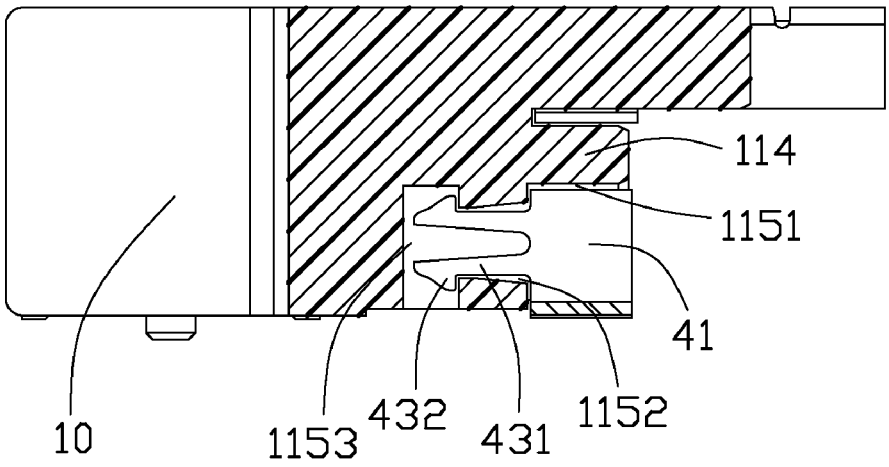
FIG. 5 is a cross-sectional view of the card edge connector shown in FIG. 1 along line 5-5.

Referring to FIG. 5, the vertical receiving slot 115 comprises a front slot 1151, a rear slot 1153 adjacent to the base portion 10 and a connecting slot 1152 between the front and rear slots. A front bottom face of the supporting portion 114 is cut so as to form an aperture 119 thereat. When the soldering pad 4 inserts into the receiving slot 115 along a front-to-rear direction, the body portion 41 is exactly received in the front slot 1151 and the solder portion 42 projects out of the front slot 1151 so as to be received in the aperture 119. The rear slot 1153 runs through the bottom face of the supporting portion 114 according to the requirement of the molding process. The width of the connecting slot 1152 generally becomes narrower along the front-to-rear direction, and the narrowest width of the connecting slot 1152 is smaller than the width between the pair of hooks 432, therefore when the hooks 432 go through the connecting slot 1152, the hooks 432 will be urged to move face-to-face so as to surpass the connecting slot 1152. The hooks 432 will return to its initial status when they reach to the rear slot 1153 and the hooks 432 can not release from the rear slot 1153 so as to keep the soldering pad 4 retaining on the insulative housing 1. As there is an aperture between the connecting portions 431 and the connecting slot 1152, the connecting portions 431 could move upwardly or downwardly so as to adjust the solder portion 42 to be coplanar with a soldering surface defined by solder tails 21 of the conductive terminals 2.

As the soldering pad 4 is assembled onto the supporting portion 114 and adjacent to the bottom face of the insulative housing 1, the soldering pad 4 can be formed with a small and simple configuration, which is easily for manufacturing and reducing the cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for connecting an electrical card to a printed circuit board comprising:

an elongated housing defining a mating cavity extending along a longitudinal direction and a pair of arms disposed at opposite ends of the mating cavity, a supporting portion unitarily extending forward from the housing;

a plurality of contacts, divided into an upper row and a lower row, and respectively secured on opposite sides of the mating cavity; and metallic devices, comprising a pair of retaining members respectively attached to the arms and a pair of soldering pads respectively assembled onto the supporting portions along a front-to-rear direction perpendicular to the longitudinal direction;

wherein each supporting portion defines a receiving slot running through a front face of the supporting portion and extending along the front-to-rear direction for receiving said soldering pad under condition that the soldering pad could floatably move within the receiving slot.

2. The card edge connector as described in claim 1, wherein the retaining members are located at a higher level than the soldering pads in a vertical direction perpendicular to the longitudinal direction.

3. The card edge connector as described in claim 2, wherein each arm comprises a second side arm and a first side arm located at a lateral side of the second side arm, the retaining members are attached to the second side arms while the soldering pads are located under the first side arms.

4. The card edge connector as described in claim 3, wherein an interval is defined between the second side arm and the supporting portion for receiving a buckling portion extending laterally from a bottom edge of each retaining member.

5. The card edge connector as described in claim 1, wherein said receiving slot comprises a vertical front slot, a vertical rear slot and a ring like connecting slot located therebetween, the soldering pad has a pair of fork shaped locking portions inserted into said vertical rear slot through the connecting slot.

6. The card edge connector as described in claim 5, wherein each soldering pad has a body portion, a solder portion extending from a bottom edge of the body portion, and said locking portions extending from a lateral edge which is connected with said bottom edge.

7. The card edge connector as described in claim 6, wherein said locking portions and the body portion are formed in a same plane.

8. The card edge connector as described in claim 7, wherein a front bottom surface of the supporting portion is cut so as to receive said solder portion of the soldering pad.

9. The card edge connector as described in claim 8, wherein the vertical rear slot runs through the bottom surface of the supporting portion.

10. The card edge connector as described in claim 9, wherein an opening is defined on the solder portion of each soldering pad.

11. A card edge connector comprising:

an insulative housing defining an elongated base with a pair of arms at two opposite ends in a longitudinal direction, each of said arms extending in a front-to-back direction perpendicular to said longitudinal direction, and defining a lower supporting portion and an upper latching portion, a receiving slot formed in the supporting portion, a soldering pad assembled into the receiving slot, the latching portion defining an inner deflectable arm and an outer rigid arm with therebetween a gap in said longitudinal direction; wherein the supporting portion is essentially aligned with the outer rigid arm, and the receiving slot communicates with an exterior in said front-to-back direction and a vertical direction perpendicular to both said front-to-back direction and said longitudinal direction with a stepped structure therein, and the solder pad defines a planar body portion lying in a vertical plane with a hook in a front end to be hooked to the stepped structure, and a solder portion linked at a bottom edge of the body portion and extending in a horizontal plane under condition that said soldering pad is floatably received in the receiving slot.

12. The card edge connector as claimed in claim 11, wherein the body portion is dimensioned smaller than the supporting portion in said front-to-back direction.

13. The card edge connector as claimed in claim 12, wherein a gap is formed between the outer rigid arm and the supporting portion in the vertical direction.

14. The card edge connector as claimed in claim 13, wherein the gap between the outer rigid arm and the supporting portion is dimensioned similar to the body portion in the front-to-back direction.

* * * * *